US005357895A

United States Patent [19]

Ceko

[11] Patent Number: 5,357,895

[45] Date of Patent: Oct. 25, 1994

[54] ILLUMINATED MARINE ADVERTISING VESSEL

[75] Inventor: Peter Ceko, Chicago, Ill.

[73] Assignee: CEKCOM Corporation, Chicago, Ill.

[21] Appl. No.: 78,524

[22] Filed: Jun. 16, 1993

[51] Int. Cl.[5] ..... B63B 35/00

[52] U.S. Cl. ..... 114/343; 40/592; 114/61; 114/270

[58] Field of Search ..... 114/61, 270, 102, 343; 40/592, 610, 646

[56] References Cited

U.S. PATENT DOCUMENTS

| | | | |
|---|---|---|---|
| H1,051 | 5/1992 | Briguglio | 441/21 |
| D. 199,341 | 10/1964 | Bodiford . | |
| D. 234,231 | 1/1975 | Alfonso . | |
| 679,693 | 9/1904 | Forbes . | |
| 1,632,973 | 6/1927 | Johanknegt | 114/270 |
| 2,415,056 | 1/1947 | Wheeler . | |
| 2,497,065 | 2/1950 | Braddon . | |
| 2,883,863 | 4/1959 | Karsten et al. . | |
| 3,124,007 | 3/1964 | Swinney . | |
| 3,313,163 | 4/1967 | Flannelly . | |
| 3,563,335 | 2/1971 | Holmes et al. | 114/122 |
| 3,742,770 | 7/1973 | Flannelly . | |
| 3,758,972 | 9/1973 | Egermayer | 40/125 |
| 4,453,483 | 6/1984 | Shallenberger | 114/102 |
| 4,680,148 | 7/1987 | Arbisi et al. | 441/21 |
| 4,909,169 | 3/1990 | Skandaliaris et al. | 114/61 |
| 4,912,865 | 4/1990 | Ellsworth et al. | 40/602 |
| 4,957,258 | 9/1990 | Tiedemann | 40/602 |
| 5,132,666 | 7/1992 | Fahs | 40/592 |
| 5,184,561 | 2/1993 | Nickell, Jr. | 114/61 |

FOREIGN PATENT DOCUMENTS

| | | | |
|---|---|---|---|
| 1575639 | 6/1969 | France | 40/584 |

*Primary Examiner*—Jesus D. Sotelo
*Attorney, Agent, or Firm*—Baker & McKenzie

[57] ABSTRACT

A water borne billboard is provided in the form of a marine vessel designed to accommodate a billboard for display along heavily populated coastlines. The billboard is two-sided, both side being visible to observers on the coastline by either rotating the pivotally mounted billboard while the vessel is moving or reversing the direction of the vessel. The vessel is operated by one or more operators and may be designed to conceal the operators from view by the observers. The vessel is propelled by conventional means such as an internal combustion engine or an electric motor.

6 Claims, 3 Drawing Sheets

ILLUMINATED MARINE ADVERTISING VESSEL

This invention relates generally to the field of outdoor advertising and specifically billboard-type outdoor advertising. More particularly, the invention relates to a marine vessel that carries a billboard that can be easily viewed from a nearby coastline. In the preferred embodiment, the billboard is lighted to facilitate viewing at night.

BACKGROUND OF THE INVENTION

The concept of billboard-type advertising is well-known. Billboards prominently displayed along the nation's highways have been used for decades. Billboards have become an increasingly important type of advertising for the alcohol and tobacco industries because of restrictions on alcohol and tobacco advertising on television and radio. Billboards also are an important form of advertising for local events and attractions such as fairs, festivals, auctions as well as the opening of local businesses such as restaurants and retail establishments.

Another common type of outdoor advertising is the use of portable billboards carried by planes and automobiles. Specifically, it is well known to fly airplanes carrying banners that promote local events, services or products above crowds gathered at a large stadium for a sporting event. Lately, it has become a common practice to employ a truck or a van to transport a billboard-type display in crowded cities and towns advertising a new product, event or service.

However, there has been no successful portable, outdoor billboard-type advertising scheme employed in marine environments. Specifically, it would be highly beneficial to provide a marine vessel capable of providing billboard-type advertising along crowded beaches or parks located next to a coastline. Local events could be advertised to large numbers of vacationing consumers and the marine-based billboards would also be an effective means of advertising for alcohol and tobacco products.

SUMMARY OF THE INVENTION

The present invention provides a marine vessel ideally equipped to carry billboards for use in advertising events, products and services along a coastline. A relatively flat vessel is provided that may have a mono hull bottom or include at least two pontoons, i.e., a catamaran-type hull. A propulsion system in the form of an internal combustion engine or an electric motor is provided to propel the vessel up and down a coastline in front of crowds of people.

In the preferred embodiment, a surface deck is provided upon which billboard supports are fixedly mounted. The billboard is suspended between two supports and is preferably rotatably mounted to the supports. The preferred billboard is two-sided, one side facing outward from the port side of the vessel and one side facing outward from the starboard side of the vessel. If the billboard is rotatably mounted to the supports, the sign can be rotated or reversed thereby exposing both sides of the billboard to the coastline without turning the vessel around.

In the preferred embodiment, lights are provided on both the port and starboard sides to illuminate the billboard at night. It is also foreseeable that electronic-type billboards could be employed with the present invention thereby enabling a variety of displays on each side of the billboard without rotating or switching the billboard.

It is therefore an object of the present invention to provide a marine-based portable billboard system.

Another object of the present invention is to provide an improved means of advertising directed to consumers gathered on beaches and parks disposed along a coastline.

Yet another object of the present invention is to provide an improved means of advertising events, products and services to consumers gathered along coastlines at night.

Another related object of the present invention is to provide a marine vessel suitable for use in displaying billboards along coastlines.

Other objects and advantages of the invention will become apparent upon reading the following detailed description and appended claims, and upon reference to the accompanying drawings.

BRIEF DESCRIPTION OF THE DRAWINGS

This invention is illustrated more or less diagrammatically in the accompanying drawings, wherein.

DETAILED DESCRIPTION OF THE INVENTION

Figure 1:
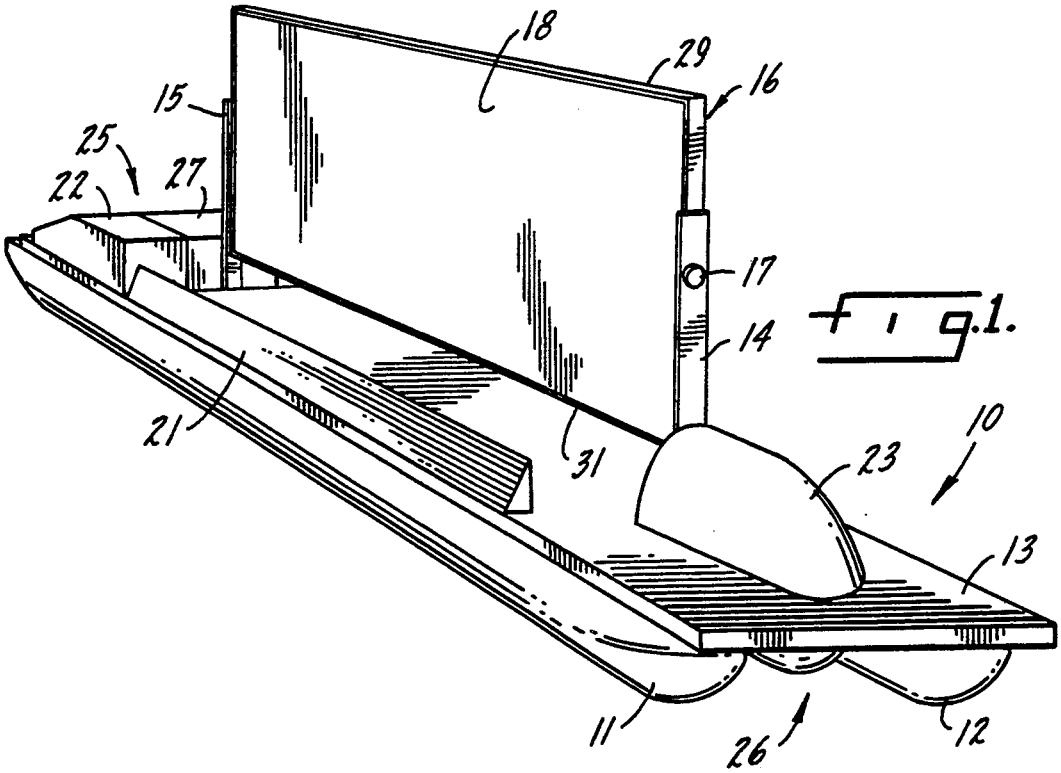
FIG. 1 is a perspective view of a marine advertising vessel made in accordance with the present invention.

Like reference numerals will be used to refer to like or similar parts from Figure to Figure in the following description of the drawings.

It should be understood that the drawings are not necessarily to scale and that the embodiment shown herein is sometimes illustrated by graphic systems and diagrammatic representations. In certain instances, details which are not necessary for an understanding of the present invention or which render other details difficult to perceive may have been omitted. It should be understood, of course, that the invention is not necessarily limited to the particular embodiment illustrated herein.

Turning to FIG. 1, one preferred embodiment of the present invention is shown. Specifically, the marine vessel 10 includes pontoons 11, 12 as primary flotation devices. The surface deck 13 is disposed on top of the pontoons 11, 12 and accommodates the support structures 14, 15 to which the billboard 16 is mounted. The billboard, or means for displaying indicia 16, may be pivotally attached to the supports 14, 15 via bolts, like the one shown at 17, and therefore the billboard 16 may be rotatably mounted to supports 14, 15 so that both opposing sides or surface 18, 19 (see FIG. 3) may be displayed to people on a coastline without changing the direction of the vessel 10. The light fixture shown at 21 provides a means for illuminating the surface area 18 of the billboard 16 to enable the vessel 10 to be a useful advertising tool at night. Other features shown in FIG. 1 include a fuel tank 22, an operator control station 23 and bow 26.

Figure 2:
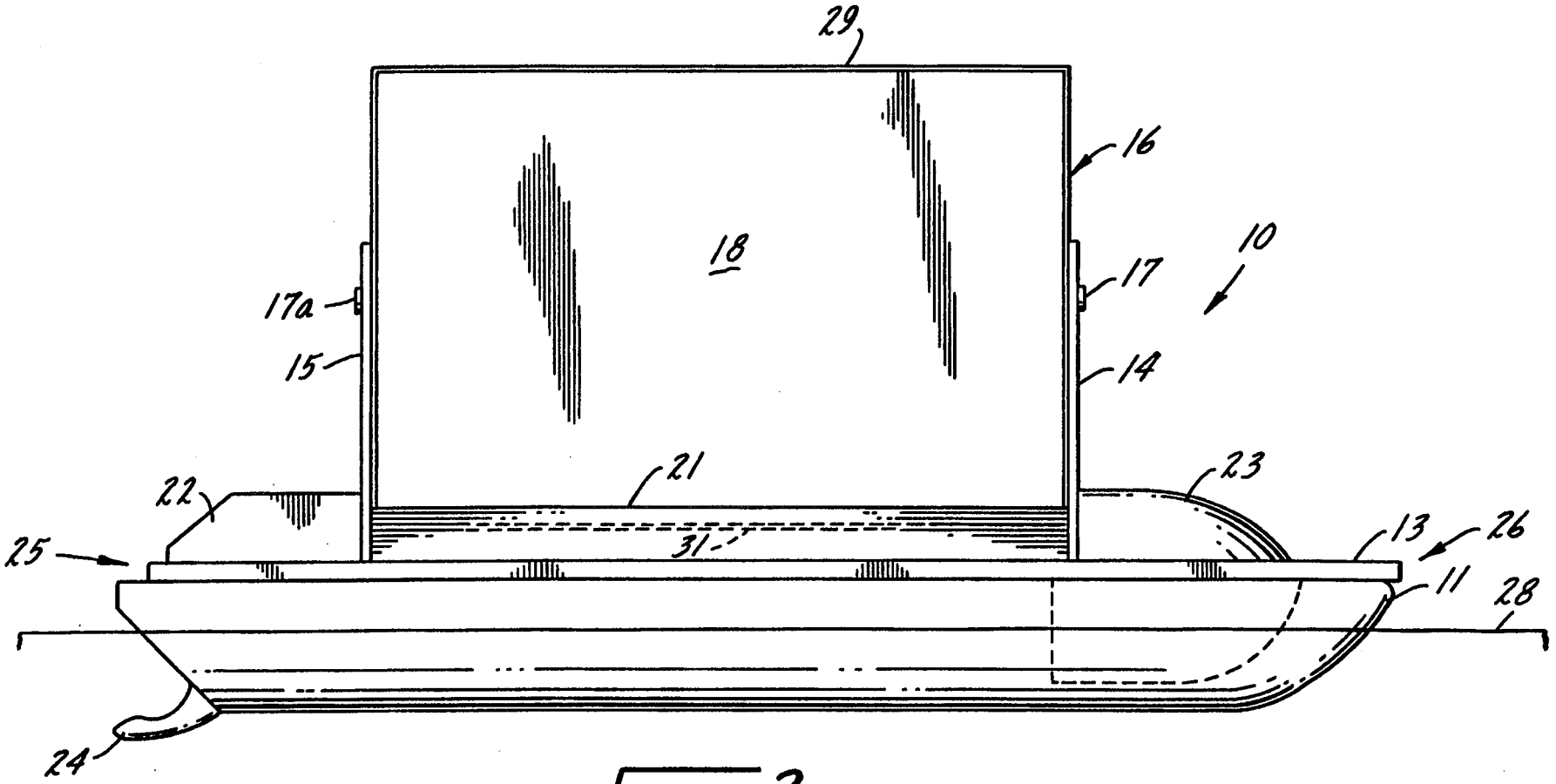
FIG. 2 is a starboard side view of the marine vessel shown in FIG. 1.

Turning to FIG. 2, a view of the vessel 10 as seen from the coastline is presented. Consumers can easily see the indicia displayed on the surface area 18 of the billboard 16. Rotation of the billboard 16 about the bolts or fasteners 17, 17*a* enables the surface area 18 to be pivoted 180° for presentation of the surface area 19 outward toward the coastline. It will also be noted that the supports 14, 15 and fasteners 17, 17*a* could be positioned at the top 29 and bottom 31 of the billboard 16 thereby enabling rotation of the billboard 16 about a vertical axis as opposed to the horizontal axis of rotation as provided in the figures. A variety of propulsion means 24 may be provided in the form of propellers or jets. Also, an outboard motor may be mounted to the stern 25 or other areas of the vessel.

Figure 3:
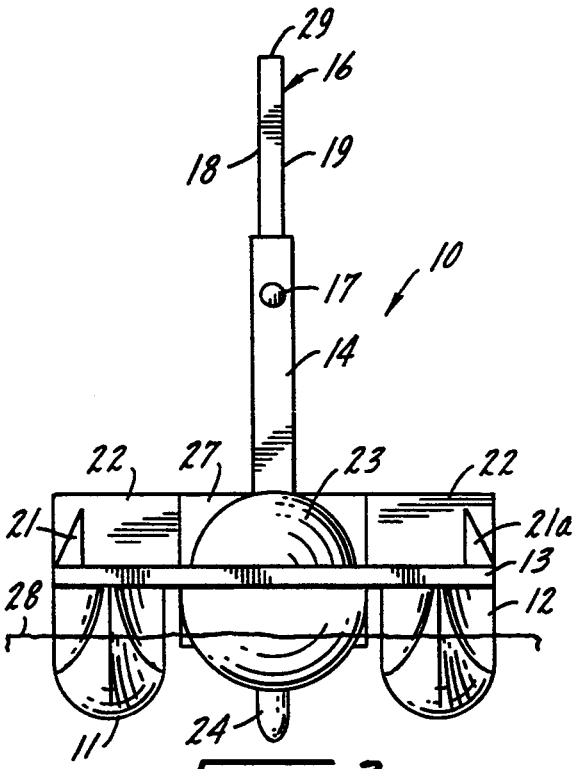
FIG. 3 is a front or bow side view of the marine vessel shown in FIG. 1.
Figure 4:
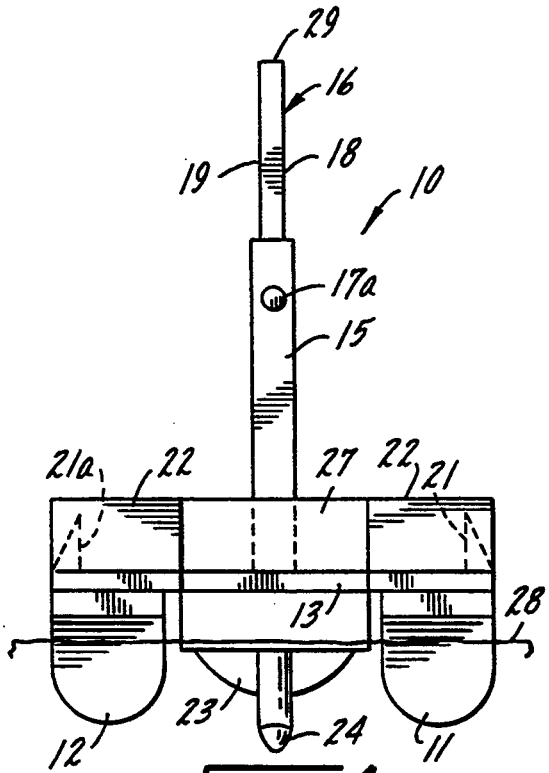
FIG. 4 is a rear or stern side view of the marine vessel shown in FIG. 1.
Figure 5:
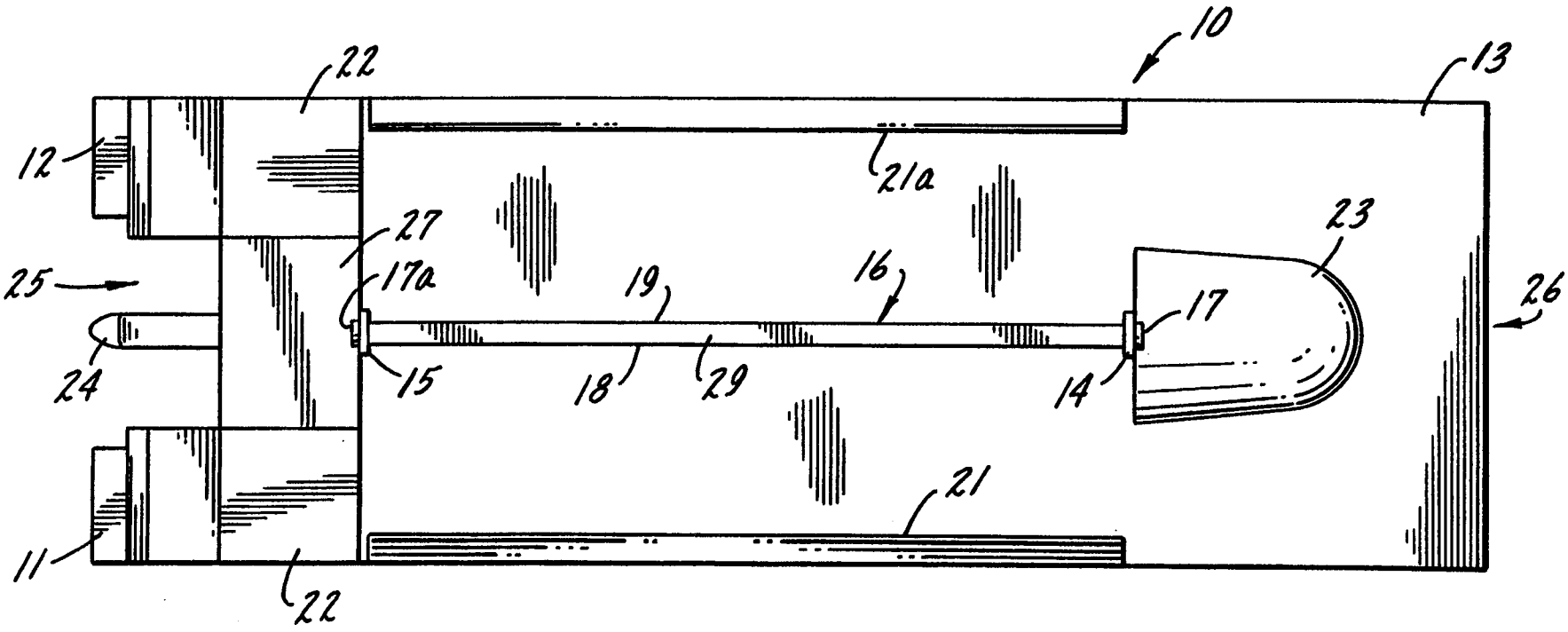
FIG. 5 is a top plan view of the marine vessel shown in FIG. 1.

Turning to FIG. 3, a front end view or a view of the bow 26 is shown. A view of the propellant or engine is illustrated at 27 as well as the port side lighting at 21*a*. As seen in FIGS. 3 and 4, the operator control station 23 may extend below the water line 28 and may even provide complete enclosure of the operator and therefore hide the operator from view. The operator would stay cool in the control station 23 on hot days due to the partial submersion of the operation control station 23 below the surface of the water 28. Finally, as seen in FIG. 5, the surface deck 13 provides ample room for the operator to maneuver the billboard 16 in the event that the billboard 16 needs to be rotated about the pivots 17, 17*a*.

Thus, one embodiment of a marine vessel 10 suitable for use as a moving billboard display vessel is shown and described. Of course, other embodiments will be readily apparent to those skilled in the art. Specifically, a variety of vessel designs including but not limited to mono hull embodiments or vessels employing a catamaran-type hull could be used. It is also foreseeable that electronic billboards could be used which would enable a variety of graphic presentations to be displayed on the surface areas 18, 19.

Although only one preferred embodiment of the present invention has been illustrated and described, it will at once be apparent to those skilled in the art that variations may be made within the spirit and scope of the invention. Accordingly, it is intended that the scope of the invention be limited solely by the scope of the hereafter appended claims and not by an specific wording in the foregoing description.

We claim:

1. A motor boat for the display of advertising, the motor boat comprising:

a bow, a stern and port and starboard sides, at least two pontoons including a port pontoon and a starboard pontoon, a surface deck mounted on top of the port and starboard pontoons, a motor attached to the surface deck at a stern end thereof, a billboard mounted in an upright position on the surface deck between two upwardly protruding supports, the billboard disposed between the stern side and the bow side, the billboard being unitary and providing a unitary port surface area facing outward from the port side of the boat and a unitary starboard surface area facing outward from the starboard side of the boat, the unitary port surface area and the unitary starboard surface area being for the display of advertising indicia, an operator control station disposed between the billboard and the bow side, an upper portion of the operator control station disposed above the surface deck and a lower portion of the operator control station being disposed below the surface deck, the lower portion of the operator control station being at least partially submerged under water when the boat is in operation, the operator control station providing a seat for an operator and housing a steering mechanism, a port light fixture for illuminating the unitary port surface area, a starboard light fixture for illuminating the unitary starboard surface area, the boat being capable of cruising up and down a coastline in a path generally parallel to to the coastline, whereby the unitary port and starboard surface areas are visible from a coastline as the boat travels up or down the coastline.

2. The motor boat of claim 1, wherein the billboard is rotatably attached to the protruding supports so that the unitary port surface area and the unitary starboard surface area may be reversed without changing the direction of the boat.

3. A motor boat for the display of advertising, the motor boat comprising:

a bow, a stern and port and starboard sides, a surface deck mounted on top of the port and starboard pontoons, a motor attached to a stern end of the surface deck, a billboard mounted in an upright position on the surface deck between two upwardly protruding supports, the billboard extending between the stern side and the bow side of the boat, the billboard being unitary and providing a unitary port surface area facing outward from the port side of the boat and a unitary starboard surface area facing outward from the starboard side of the boat, the unitary port surface area and the unitary starboard surface area being for the display of advertising indicia, an operator control station disposed between the billboard and the bow side, an upper portion of the operator control station disposed above the surface deck and a lower portion of the operator control station being disposed below the surface deck, the lower portion of the operator control station being at least partially submerged under water when the boat is in operation, the operator control station providing a seat for an operator, the boat being capable of cruising up and down a coastline in a path generally parallel to the coastline, whereby the port and starboard surface areas are visible from a coastline as the boat travels up or down the coastline.

4. The motor boat of claim 3, wherein the billboard is rotatably attached to the protruding supports so that the unitary port surface area and the unitary starboard surface area may be reversed without changing the direction of the boat.

5. The motor boat of claim 4, further comprising a port light fixture for illuminating the unitary port surface area, a starboard light fixture for illuminating the unitary starboard surface area.

6. The motor boat of claim 5, wherein the motor is an outboard motor attached to the stern end of the surface deck.

* * * * *